US005984782A

United States Patent [19]

Inoue

[11] Patent Number: 5,984,782

[45] Date of Patent: Nov. 16, 1999

[54] SLOT MACHINE

[75] Inventor: Haruo Inoue, Tokyo, Japan

[73] Assignee: Eagle Co., Ltd., Tokyo, Japan

[21] Appl. No.: 08/993,189

[22] Filed: Dec. 18, 1997

[51] Int. Cl.[6] ..... A63F 5/04

[52] U.S. Cl. ..... 463/20; 463/20; 273/143 R; 273/138

[58] Field of Search ..... 463/20, 16–19, 463/12, 13; 273/143 R, 138 A

[56] References Cited

FOREIGN PATENT DOCUMENTS

| | | |
|---|---|---|
| 60-185579 | 9/1985 | Japan . |
| 7-275432 | 10/1995 | Japan . |
| 6-686 | 1/1997 | Japan . |

OTHER PUBLICATIONS

U.S. Ser. No. 08/399,922 issued Mar. 3, 1998 to Haruo Inoue filed Mar. 7, 1995.

*Primary Examiner*—Jessica J. Harrison
*Assistant Examiner*—Sheila Clayton
*Attorney, Agent, or Firm*—Young & Thompson

[57] ABSTRACT

A slot machine has a first reel group and a second reel group. The second reel group is constituted of auxiliary reels, on a peripheral surface of which re-rotation symbols are arranged. The auxiliary reels are respectively provided so as to correspond to each reel constituting the first reel group. After all the reels of the first reel group have stopped, any of the reels thereof is re-rotated and stopped if the corresponding auxiliary reel stops the re-rotation symbol at a predetermined position. Thus, a symbol combination displayed by the first reel group is changed in accordance with the auxiliary reel. It is preferable that the re-rotation symbol represents a rotational direction and a rotational amount of the re-rotated reel of the first reel group.

17 Claims, 7 Drawing Sheets

SLOT MACHINE

BACKGROUND OF THE INVENTION

1. Field of the Invention

The present invention relates to a slot machine in which occurrence of a winning is judged in accordance with a combination of symbols stopping at a winning line.

2. Description of the Related Art

As well known, a slot machine has a plurality of reels or a CRT. The reel is rotatable and is provided with symbols arranged on a peripheral surface thereof. On the other hand, the CRT displays the symbols on the basis of graphic data stored in ROM. The symbol displayed in the CRT is moved so as to simulate the rotation of the reel. In such a slot machine, the reels are rotated together by an operation of a start button or a start lever after inserting a coin, a token and so forth (hereinafter, coin). The reel is stopped by an operation of a stop button provided for each reel or after a predetermined time has passed. When the reels have stopped, occurrence and kind of winning is determined in accordance with a combination of the symbols stopping at a predetermined winning line. When the winning is obtained, coins, number of which is predetermined, are paid out according to the kind of the winning.

There are various kinds of winning. For example, there is a winning such that the coins, number of which is from five to fifteen, are paid out when the prescribed symbols of two or three kinds are displayed at the winning line. Besides that, there are a jackpot winning, a bonus game winning and so forth. As to the jackpot winning, a great deal of dividend is obtained when the specific symbol combination, for example, "7-7-7" is displayed along the winning line. Regarding the bonus game winning, a bonus game is given. In the bonus game, winnings occur frequently at high probability in comparison with the normal game. In such slot machine, it becomes a great pleasure for a player whether various winnings are obtained or not.

In order to increase the pleasure of the slot machine, Japanese Patent Laid-Open Publication No. 60-185579 discloses a slot machine in which a winning chance is obtained again by re-rotating the reel after it has stopped once.

Moreover, Japanese Patent Laid-Open Publication No. 7-275432 discloses a slot machine having a first reel group for normal game and a second reel group for bonus game. The second reel group is used only when the specific symbols of the first reel group are arranged along the winning line, namely, the bonus game is obtained. Such slot machine has various game modes in the bonus game.

However, regarding the slot machine in which the reel stopped once is re-rotated when the game is lost, one set of the reels is used to decide whether the chance for re-rotating the reel is given or not, besides determining whether the winning occurs or not. Accordingly, even if winning chance according to the re-rotation of the reel is taken, a feeling that the game is extended is merely given to the player. Particularly, great expectation and interest for the winning are not given to the player.

As to the slot machine employing the second reel group used only for the bonus game besides the reel for the normal game, freshness is given for the bonus game. However, while the normal game is played, this slot machine is not different from a conventional one. Further, winning probability of the bonus game is set at low so that most of the players might lose the interest before playing the bonus game utilizing the second reel group.

SUMMARY OF THE INVENTION

In view of the foregoing, it is a primary object of the present invention to provide a slot machine in which freshness and interest are rich.

It is a second object of the present invention to provide a slot machine in which a game mode may be variously changed.

It is a third object of the present invention to provide a slot machine in which expectation feeling of a player is increased.

In order to achieve the above and other objects, the slot machine according to the present invention comprises a first reel group and a second reel group. The first reel group is constituted of a plurality of main reels. By operating a start lever, the main reels are rotated. After that, when these reels have stopped, a winning is judged on the basis of a symbol combination stopping along a predetermined winning line. The second reel group is constituted of at least one auxiliary reel having a re-rotation symbol arranged on a peripheral surface thereof. If the re-rotation symbol stops at a predetermined position, at least one of the main reels is re-rotated.

In a preferred embodiment according to the present invention, the auxiliary reel is provided for each main reel so as to correspond to each other one by one. After all the main reels have stopped, any of these reels is re-rotated and stopped if the corresponding auxiliary reel stops the re-rotation symbol at the predetermined position. Thus, the symbol combination of the main reels displayed at the predetermined winning line is changed in accordance with a stop state of the auxiliary reel.

With regard to the re-rotation of the main reels, it is preferable to indicate a rotational direction and a rotational amount thereof by utilizing the re-rotation symbol of the auxiliary reel. In order to indicate these, the re-rotation symbol includes an arrow pointing the rotational direction, namely an upward direction or a downward direction. Further, a numeral representing the rotational amount is also included in the re-rotation symbol.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
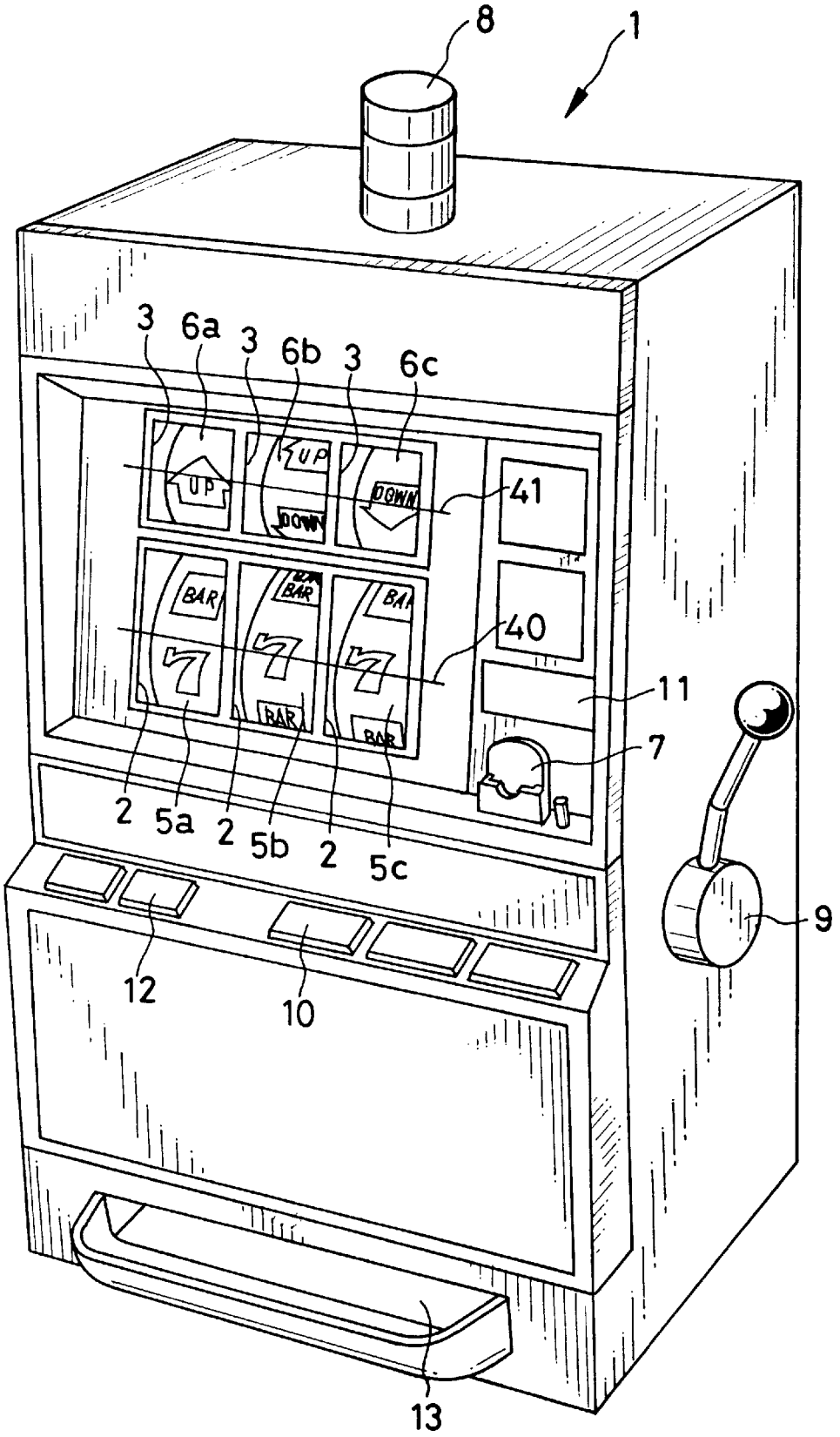
FIG. 1 is a perspective view of a slot machine according to the present invention.

In FIG. 1 showing an appearance of a slot machine 1 according to the present invention, a front panel is provided with symbol displaying windows 2 and 3 arranged in up-and-down direction. Three main reels 5*a*, 5*b* and 5*c* are provided behind the symbol displaying window 2. The main reels 5*a*, 5*b*, and 5*c* are rotatable around rotational shafts respectively. The shafts are coaxially disposed in horizontal direction. Plural kinds of symbols are arrange on a peripheral surface of each main reel. The number of the symbols arranged on the main reel is about twenty. When all of the main reels have stopped, a symbol combination is determined at a winning line 40. Further, occurrence and a kind of the winning are judged in accordance with the symbol combination. The main reels 5*a*, 5*b* and 5*c* constitute a first reel group for judging whether the winning occurs or not.

Similarly, three auxiliary reels 6*a*, 6*b*, and 6*c* are provided behind the symbol displaying window 3. These auxiliary reels 6*a*, 6*b* and 6*c* have smaller diameter than that of the main reel 5*a*, 5*b* and 5*c* constituting the first reel group. About eight symbols are arranged on a peripheral surface of the auxiliary reel. Each of the auxiliary reels 6*a* to 6*c* corresponds to each of the main reels 5*a* to 5*c* respectively. The auxiliary reels 6*a* to 6*c* constitute a second reel group for determining whether the main reel is re-rotated or not. The auxiliary reels of the second reel group are rotated together with the main reels of the first reel group by operating game starting means. However, stop timing of the auxiliary reels is set so as to delay for a few seconds after all of the main reels have stopped.

The symbols used for the main reel of the first reel group include valid symbols and blank symbols. The valid symbol is, for example, "7" and "BAR" as shown in FIG. 1. The blank symbol is disposed between the valid symbols one by one. From the symbol displaying window 2, five symbols including the blank symbol are visible relative to the main reel.

The winning is determined as a combination of the three valid symbols. Accordingly, if at least one blank symbol stops at the winning line 40 when all symbols of the first reel group have stopped, the game becomes failed state. But, as described later in detail, the blank symbol provided on the main reel of the first reel group is used as a specific symbol which means that the main reel is capable of re-rotating. Further, when the blank symbol stops at the winning line 40 relative to any of the reels 5*a*, 5*b*, and 5*c* of the first reel group, the reel re-rotates by an amount corresponding to one symbol in accordance with the stop position of the auxiliary reels 6*a* to 6*c*. Of course, instead of the blank symbol, other symbol being different from the valid symbol may be used as the specific symbol.

The symbols used for the auxiliary reel of the second reel group include re-rotation symbols of two kinds and blank symbols. With regard to the re-rotation symbol, a character of "UP" or "DOWN" and an arrow pointing upward or downward are combined. The blank symbol is arranged between the re-rotation symbols one by one. From the symbol displaying window 3, three symbols including the blank symbol are visible relative to the auxiliary reel. When the re-rotation symbol stops at a judging line 41 set on the symbol displaying window 3 relative to any of the reels 6*a*, 6*b* and 6*c* of the second reel group, the corresponding main reel 5*a*, 5*b* or 5*c* positioned right under the reel 6*a*, 6*b* or 6*c* is rotated in order direction or in reverse direction by the amount corresponding to one symbol on condition that the blank symbol stops at the winning line 40.

When the main reels 5*a* to 5*c* are re-rotated, rotational direction is determined in accordance with the kind of the re-rotation symbol of the auxiliary reels 6*a* to 6*c*. The blank symbol is provided on the main reels 5*a* to 5*c* every valid symbol so that the valid symbol necessarily stops at the winning line 40 when the main reel re-rotates by the amount corresponding to one symbol. By the way, the re-rotation symbol arranged on the auxiliary reel of the second reel group may also indicate a number of symbols as a indication representing a rotational amount of the re-rotation. At this time, it is possible to give a variation to the re-rotational amount of the main reel. If the re-rotational amount is set so as to correspond to symbols of odd number such as three symbols or five symbols, the valid symbol is adapted to stop at the winning line 40.

A tower lamp 8 provided on an upper portion of the slot machine 1 is constituted of chambers, each of which is made of translucent resin and has different luminous color. Further, in each of the chambers, a lamp is built. When the winning is obtained as a consequence of a game, the tower lamp 8 indicates that. The tower lamp 8 turns on brightly when the specific winning of "7-7-7" is obtained.

The front panel is further provided with a coin inlet 7, a credit button 10 and a payout button 12. On the side of the slot machine 1, a start lever 9 is provided. Prior to starting the game, a player puts the coin into the coin inlet 7. At this time, a dividend in case of winning increases in accordance with the number of inserted coins. In other words, when the number of the inserted coin is one, the dividend is a basic value. When the number of the inserted coins is two, the dividend is doubled. Further, when the number of the inserted coins is three, the dividend is trebled. In such a way, the value of the dividend increases according to the number of the inserted coins.

If many coins are put into the slot machine from the coin inlet 7 beforehand, by only pressing the credit button 10, it is substantially carried out that the coin is inserted into the coin inlet 7 actually. At this time, number of the coins inserted for the credit is decreased. This number may be confirmed by watching a display 11. When the coins are credited, if the winning is obtained, pay-out number of coins is added to the number of credit. The credited coins are paid out to a tray 13 by pressing the payout button 12.

The start lever 9 becomes valid after the coin has put into the slot machine 1. By operating the start lever 9, the reels 5*a* to 5*c* and 6*a* to 6*c* start to rotate together. Each of the reels 5*a* to 5*c* of the first reel group stop at random timing after rotating for a prescribed period. Each of the reels 6*a* to 6*c* of the second reel group stop at random timing after all reels of the first reel group have stopped.

Figure 2:
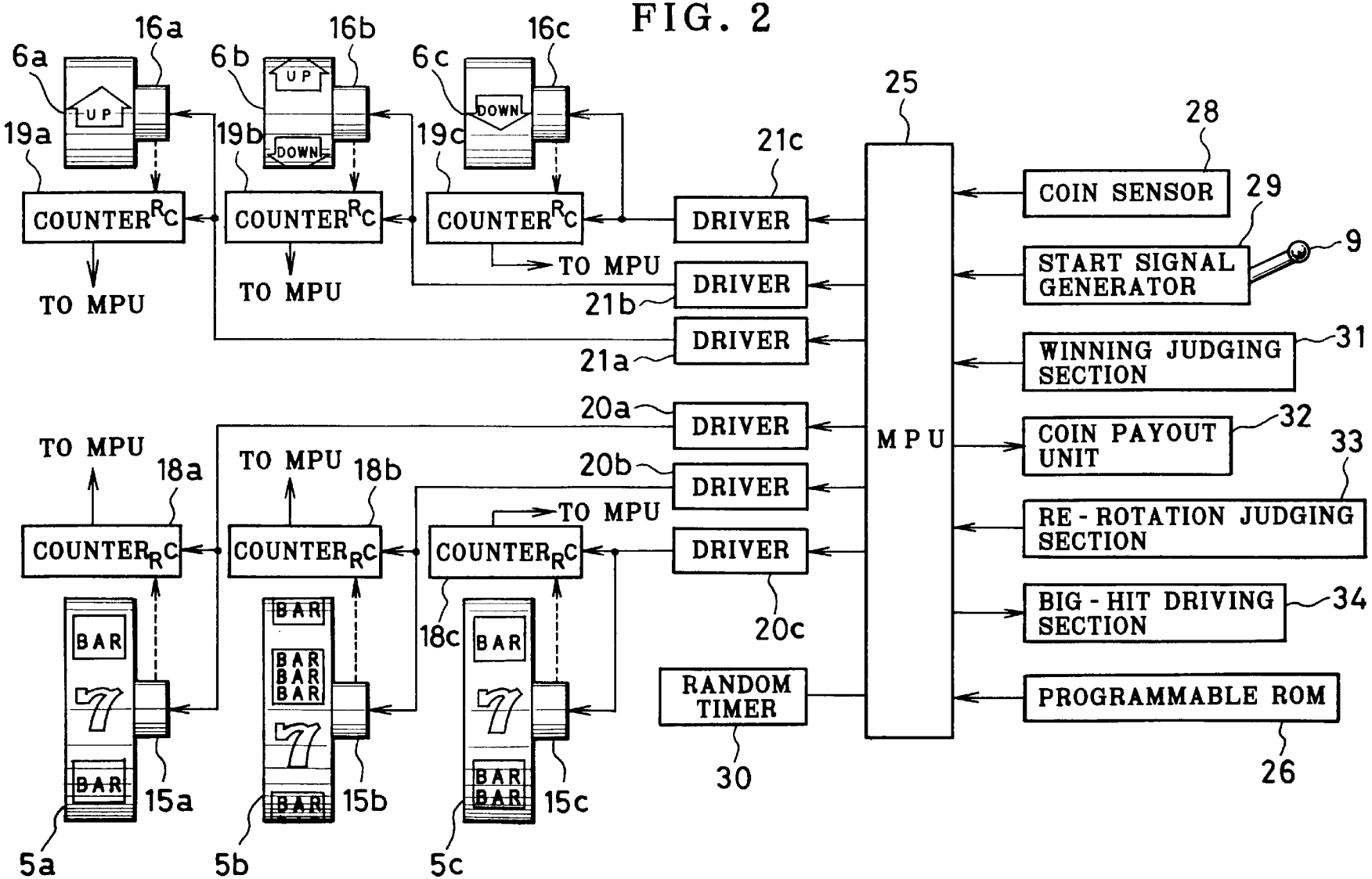
FIG. 2 is a schematic representation showing an electrical structure of the slot machine.

FIG. 2 shows a schematic electrical structure of the slot machine 1. The reels 5*a*, 5*b* and 5*c* of the first reel group are respectively driven by stepping motors 15*a*, 15*b* and 15*c* directly. Similarly, the auxiliary reels 6*a*, 6*b* and 6*c* are respectively driven by stepping motors 16*a*, 16*b* and 16*c* directly. Counters 18*a*, 18*b*, 18*c*, 19*a*, 19*b*, and 19*c* are respectively provided for each of the stepping motors. The counters 18*a* to 18*c* and 19*a*to 19*c* respectively count drive pulses supplied to the stepping motors from drivers 20*a*, 20*b*, 20*c*, 21*a*, 21*b* and 21*c*. Each of the counters is provided with a reset terminal "R" besides a count terminal "C", and a count value thereof is reset to "0" once a rotation of the stepping motor.

The reels 5*a* to 5*c* of the first reel group and the reels 6*a* to 6*c* of the second reel group are respectively controlled by means of MPU 25 so as to be automatically stopped. The MPU 25 cuts off an operation of each of the drivers 20*a* to 20*c* when the MPU 25 receives a stop signal for each reel. The stop signal is inputted from a random timer 30 at random during a short period after the stepping motors 15*a* to 15*c* have been driven for a prescribed period. Thus, all reels 5*a* to 5*c* of the first reel group stop in accordance with a stoppage of the stepping motor. At this time, each reel of the second reel group is still rotating. However, after all reels of the first reel group stopped, when the time that a symbol combination of the first reel group is confirmable by the player has passed, a stop signal for stopping the reel of the second reel group is outputted from the random timer 30. Accordingly, the reels 6*a* to 6*c* of the second reel group are similarly controlled and stop. By the way, as described later, the MPU 25 constitutes control means for re-rotating and stopping the reels 5*a*, 5*b* and 5*c* of the first reel group.

Symbol arrangement of each reel of the first reel group and the second reel group is known beforehand. Further, the symbol corresponding to a home position of each stepping motor is also known. Therefore, by inputting the count value of the counter corresponding to each reel into the MPU (micro processing unit) 25, the symbol stopping at the winning line 40 is electrically distinguished by the MPU 25.

The MPU 25 totally controls a game process in accordance with a game program stored in a programmable ROM 26. A signal from a coin sensor 28 for detecting the coin inserted into the coin inlet 7 is inputted into the MPU 25. Moreover, a signal from a start signal generator 29 for generating a game start signal is also inputted into the MPU 25. The start signal is generated when the start lever 9 is operated.

The MPU 25 refers to data stored in a winning judging section 31 and a re-rotation judging section 33 during a game. Moreover, the MPU 25 outputs a drive signal to a coin payout unit 32 and a big-hit driving section 34. The winning judging section 31 stores symbol combination data relative to a big hit and a small hit. Further, the winning judging section 31 stores a number of the dividend coins. The winning judging section 31 is referred by the MPU 25 during a winning judgement process.

The re-rotation judging section 33 is used for judging whether a re-rotation process is performed or not after all reels of the first reel group and the second reel group have stopped. Thus, the re-rotation judging section 33 stores a number of drive pulses in the case that the blank symbol of the reels 5*a* to 5*c* stops at the winning line 40. The re-rotation judging section 33 also stores a number of drive pulses in the case that the re-rotation symbol of the reels 6*a* to 6*c* stops at the judging line 41. After all reels have stopped, the MPU 25 checks whether the blank symbol stops at the winning line 40 or not relative to each of reels 5*a* to 5*c* on the basis of the count values of the counters 18*a* to 18*c*. Further, the MPU 25 checks whether the re-rotation symbol stops at the judging line 41 or not relative to each of the reels 6*a* to 6*c* on the basis of the count values of the counters 19*a* to 19*c*.

The coin payout unit 32 is driven to pay out the coins to the tray 13 in accordance with the kind of the winning when the winning is obtained as consequence of the game. The big-hit driving section 34 is driven when the big-hit winning occurs. The big-hit driving section 34 drives the stepping motors 15*a*, 15*b* and 15*c* to rotate the reels 5*a*, 5*b* and 5*c* mincingly in an order direction and a reverse direction repeatedly. In such a way, an appeal of the big-hit is made to the player.

Figure 3:
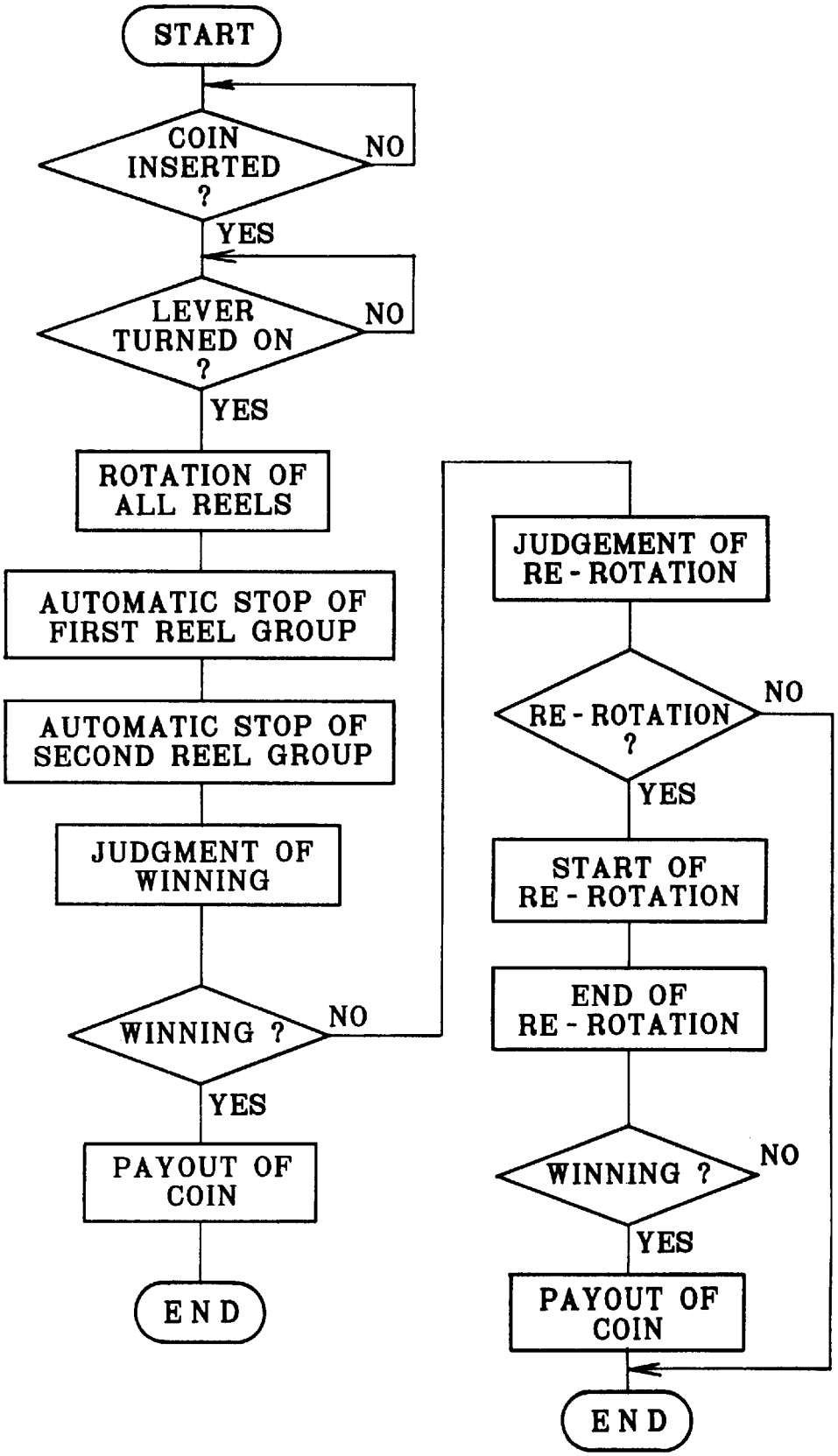
FIG. 3 is a flow chart showing a basic process of the slot machine.

Referring to a flow chart shown in FIG. 3, an operation of the slot machine is described. The game is started by operating the start lever 9 after the coin was put into the coin inlet 7. When the start lever 9 is operated, the reels 5*a* to 5*c* of the first reel group and the reels 6*a* to 6*c* of the second reel group are rotated together. After the prescribed time has passed, supply of the drive pulse is stopped for the stepping motors, each of which drives the corresponding reel, at different timing so that each of the reels 5*a* to 5*c* of the first reel group stops automatically. Right after that, each of the reels 6*a* to 6*c* of the second reel group stops automatically.

After all of the reels 5*a* to 5*c* stopped, the winning judgement process is carried out. At this time, the count values of the counters 18*a* to 18*c* are read out by the MPU 25 as described above. Successively, the winning data stored in the winning judging section 31 is referred to judge the occurrence and the kind of the winning. As a consequence of the winning judgement, in case of the winning, coins of the number according to the kind of the winning are paid out and the game is over.

When each of the reels 5*a* to 5*c* of the first reel group stops the same valid symbol at the winning line 40, namely, three valid symbols being the same are arranged at the winning line 40, the winning is obtained. For example, if three symbols of "7" are arranged at the winning line 40, one hundred coins are paid out. If three symbols of "BAR" are arranged, thirty coins are obtained. Incidentally, the pay-out number of coins may be properly determined.

As the consequence of the winning judgement, when the same valid symbols are not arranged at the winning line 40, the count values of the counters 18*a* to 18*c* are read out by the MPU 25 and the game is lost. Successively, the data stored in the re-rotation judging section 33 is referred to carried out the re-rotation judgement process.

The re-rotation judgement process is carried out in such a way that the MPU 25 reads out the count values of the counters 19*a* to 19*c* of the reels 6*a* to 6*c* and refers to the data stored in the re-rotation judging section 33. As a consequence of the re-rotation judgement process, when a condition of the re-rotation is not satisfied, the game is over.

When the re-rotation symbol stops at the judging line 41 relative to the reels 6*a* to 6*c*, the MPU 25 drives the stepping motor of the corresponding reel among the reels 5*a* to 5*c* of the first reel group if the corresponding reel stops the blank symbol at the winning line 40. The corresponding reel of the first reel group is positioned right under the reel of the second reel group. The MPU 25 supplies the drive pulses by the amount of one symbol to the driver which drives the corresponding reel of the first reel group. Accordingly, the corresponding reel is rotated by one symbol in a direction shown by the re-rotation symbol. Thus, the symbol combination displayed by the reels 5*a* to 5*c* of the first reel group is changed.

Figure 4:
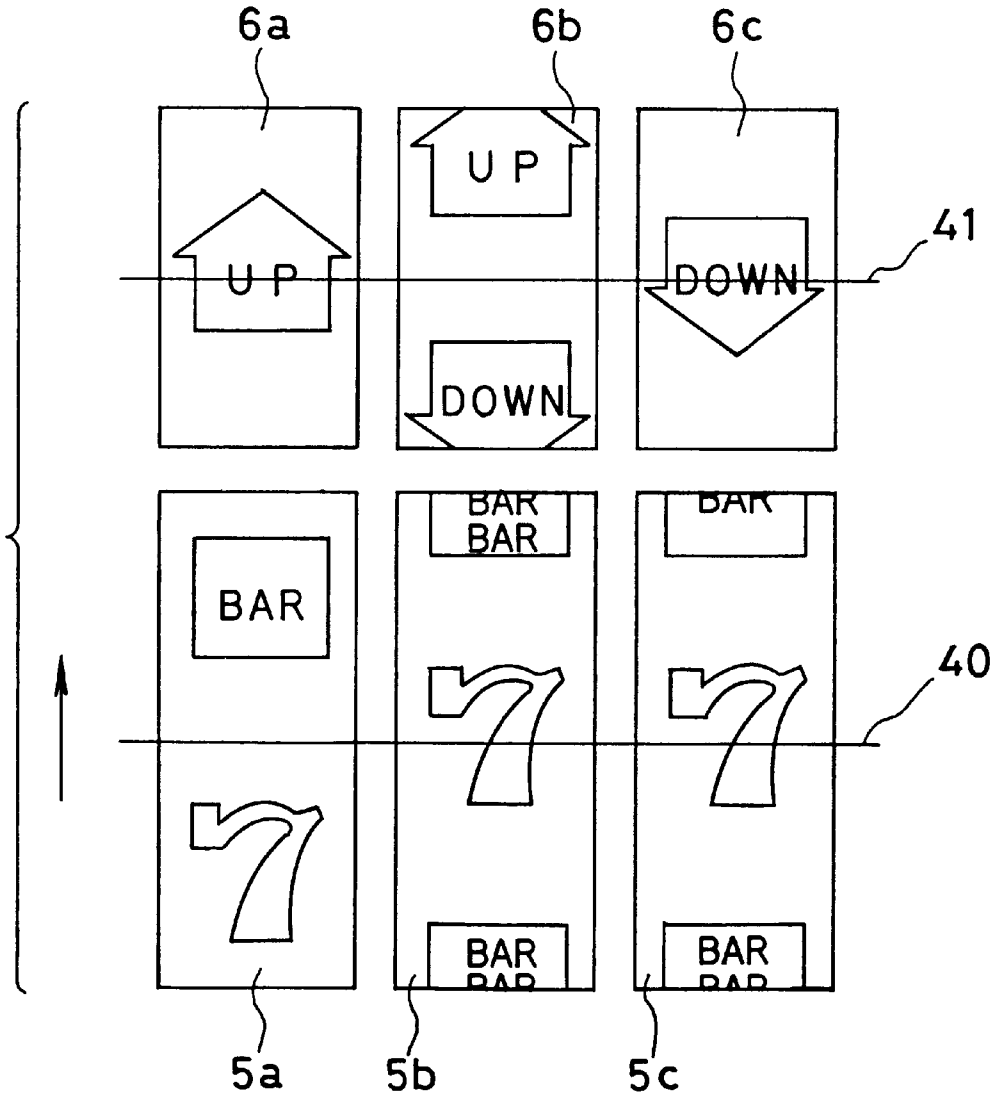
FIG. 4 is a plan view showing an example of reel stopping mode of the slot machine.

In the conventional slot machine, after all reels of the first reel group and the second reel group were rotated to start the game, if the reels 5*a* to 5*c* of the first reel group stop as shown in FIG. 4, the game is over in a state that the winning of "7-7-7" is unfortunately missed. However, in the slot machine according to the present invention, as the reel 5*a* stops in a state that the symbol "7" is shifted by one symbol, player's interest is maintained until the reels 6*a* to 6*c* of the second reel group stop. If the reel 6*a* stops at the position shown in FIG. 4, the reel 5*a* is re-rotated in the upward direction by one symbol due to the re-rotation symbol of the reel 6*a*. Accordingly, the symbol combination of "7-7-7" is obtained at the winning line 40.

In this case, the reel 6*c* of the second reel group also stops in a state that the re-rotation symbol is displayed. However, the reel 5*c* does not display the blank symbol at the winning line 40 so that the reel 5*c* is not re-rotated. If the reel 5*c* stops in a state that one symbol is shifted in the upward direction from the state shown in FIG. 4, the reel 5*c* is re-rotated by one symbol in a downward direction due to the re-rotation symbol of the reel 6*c*. Thus, the winning of "7-7-7" is similarly obtained.

When the big-hit winning is obtained, a large number of coins are paid out. At the same time, the big-hit driving section 34 drives the reels 5*a* to 5*c* of the first reel group so as to rotate them mincingly in the order direction and the reverse direction repeatedly. Thus, a great feeling of satisfaction may be given to the player when the big-hit winning is obtained. Moreover, the lamp contained in the tower lamp 8 vividly blinks so that the big-hit winning is notified to not only the player of the slot machine displaying the big-hit winning but also the surrounding player.

In the above embodiment, only one winning line 40 is set. However, it is possible to increase the number of the winning lines. The present invention is available for the conventional slot machine in which three horizontal winning lines and two diagonal winning lines are set and the number of the winning lines becoming valid changes in accordance with the number of the inserted coins. In this case, when the winning is not obtained relative to the valid winning line and the blank symbol stops at the valid winning line, the corresponding reel of the first reel group may be re-rotated according to the stop state of the reels 6*a* to 6*c* of the second reel group.

Figure 5:
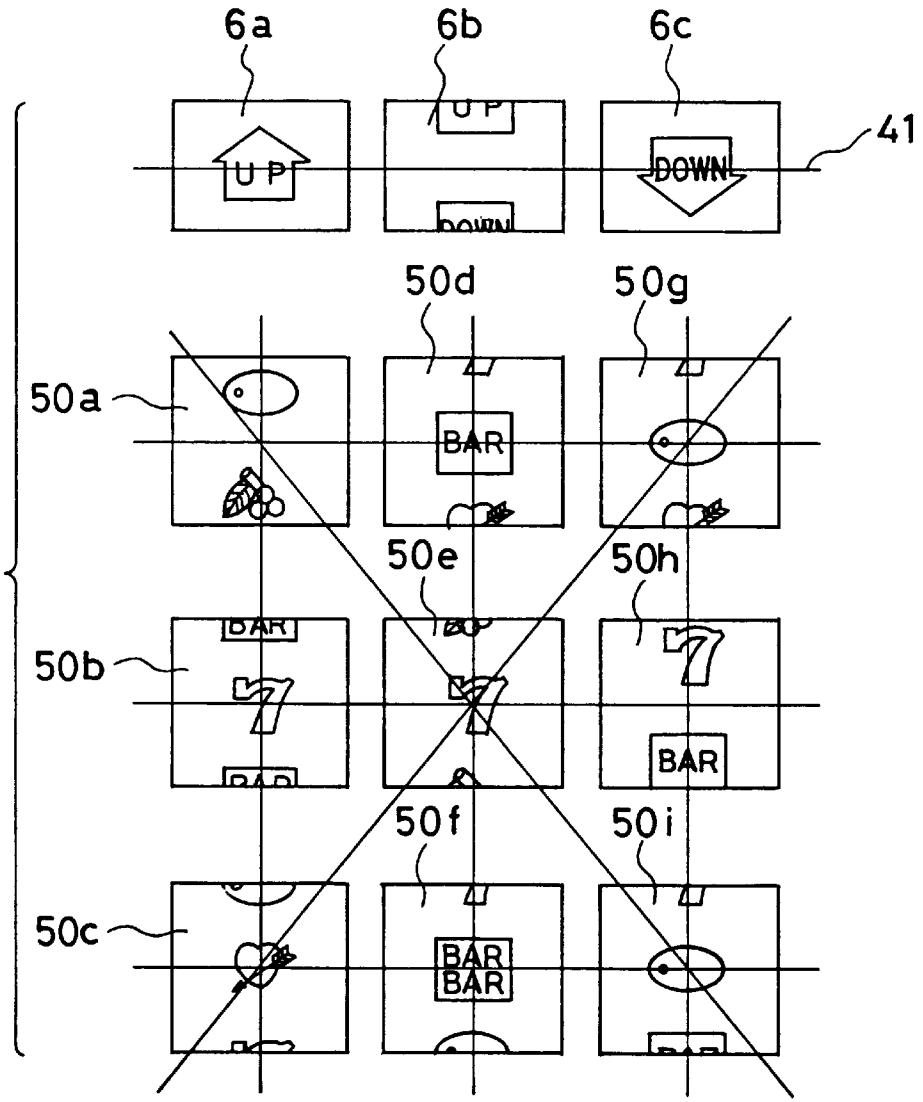
FIG. 5 is a plan view showing another embodiment of reel arrangement.

FIG. 5 shows another embodiment according to the present invention. In this embodiment, the first reel group is constituted of nine reels 50*a* to 50*i* arranged in three by three matrix. As to the winning line, there are set three horizontal winning lines, three vertical winning lines and two diagonal winning lines, namely eight winning lines. Each of the reels 6*a* to 6*c* of the second reel group is provided so as to correspond to the vertically arranged three reels 50*a* to 50*c*, 50*d* to 50*f* and 50*g* to 50*i* respectively. Similarly to the foregoing embodiment, besides the valid symbol which is constituent of the winning, the blank symbol is provided on the reels 50*a* to 50*i* of the first reel group.

When all reels have stopped, if any reel of the first reel group stops the blank symbol at the winning line and the reel of the second reel group positioned in a vertical direction relative to this blank symbol stops the re-rotation symbol at the judging line 41, the reel displaying the blank symbol is re-rotated. With regard to the reels 50*d*, 50*e* and 50*f* shown in FIG. 5, the corresponding reel 6*b* does not stop the re-rotation symbol at the judging line 41 so that the re-rotation thereof is not carried out. With regard to the reels 50*a*, 50*b* and 50*c*, since the reel 6*a* stops the re-rotation symbol at the judging line 41, the reel 50*a* is re-rotated by one symbol in the upward direction. Thus, the cherry symbol stops at the winning line. The symbol combination including the cherry symbol is one of the small-hit winning. With regard to the reels 50*g*, 50*h* and 50*i*, the reel 50*h* is re-rotated by one symbol in the downward direction. Thus, the combination of "7-7-7" is obtained. In this case, two winnings are obtained at the same time. In the case that the first reel group is constituted in such a way, even if the winning is obtained at any of the winning lines, the reel displaying the blank symbol at the other winning line is re-rotated. Accordingly, probability that the winnings are simultaneously obtained at the plural winning lines is raised.

As to the slot machine in which the nine reels 50*a* to 50*i* are arranged as described above, the symbol combination for which occurrence of the winning is judged is not exclusive to the combination positioned along the linear winning line. It is possible to set other various winning lines, for example, a rectangular winning line connecting the four reels 50*a*, 50*c*, 50*g* and 50*i* and a diamond-shaped winning line connecting the reels 50*b*, 50*d*, 50*f* and 50*h*.

Figure 6:
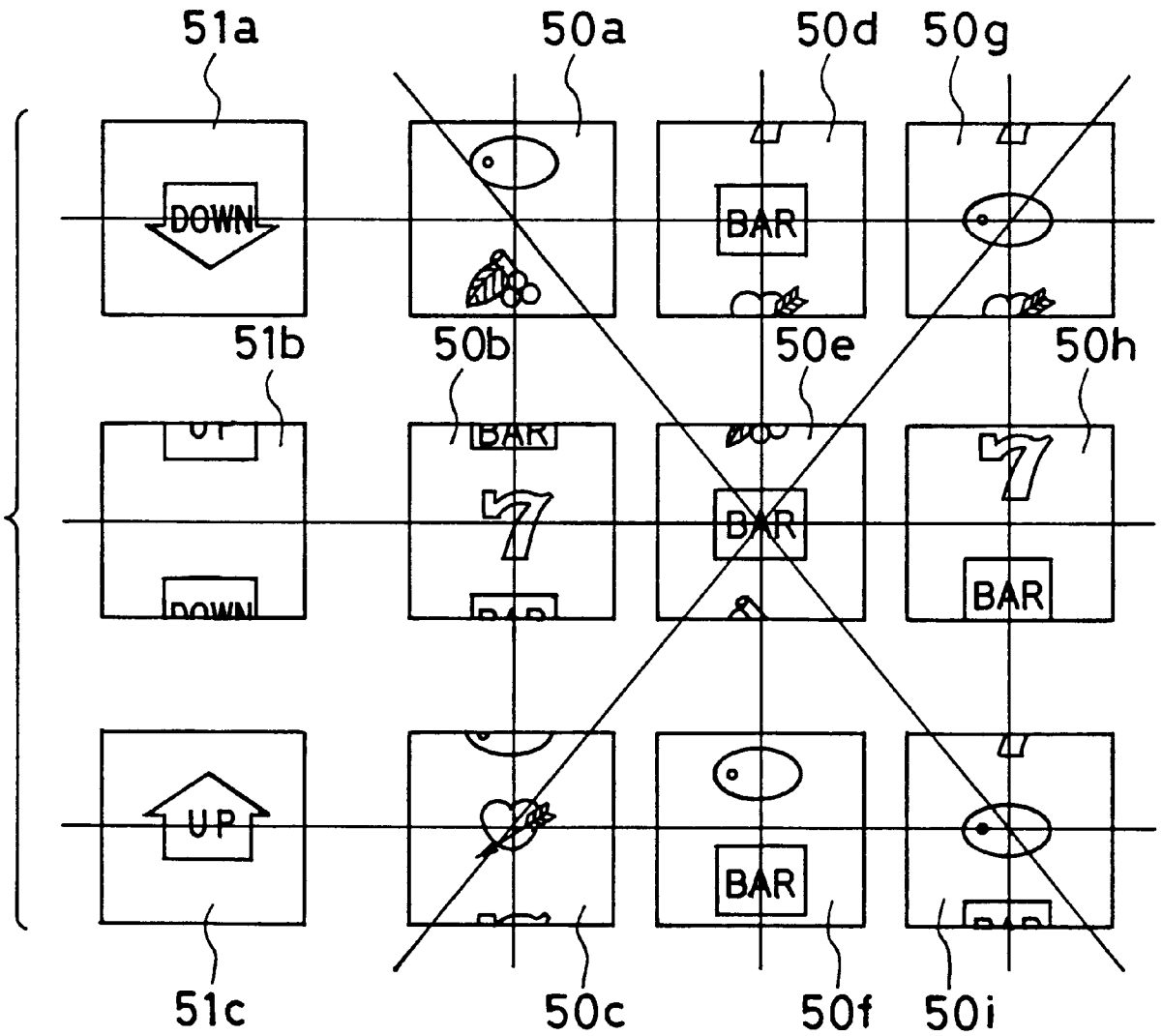
FIG. 6 is a plan view showing other embodiment of the reel arrangement.

Further, when the first reel group is constituted of the nine reels 50*a* to 50*i* disposed in three by three matrix, as shown in FIG. 6, the reels 51*a*, 51*b* and 51*c* of the second reel group may be disposed in horizontal direction relative to the first reel group. In FIG. 6, the reel 50*a* displays the blank symbol and the reel 51*a* of the second reel group displays the re-rotation symbol. Accordingly, the reel 50*a* is re-rotated by one symbol in the downward direction. Moreover, the reel 50*f* displaying the blank symbol is re-rotated by one symbol in the upward direction due to the re-rotation symbol of the reel 51*c*.

Figure 7:
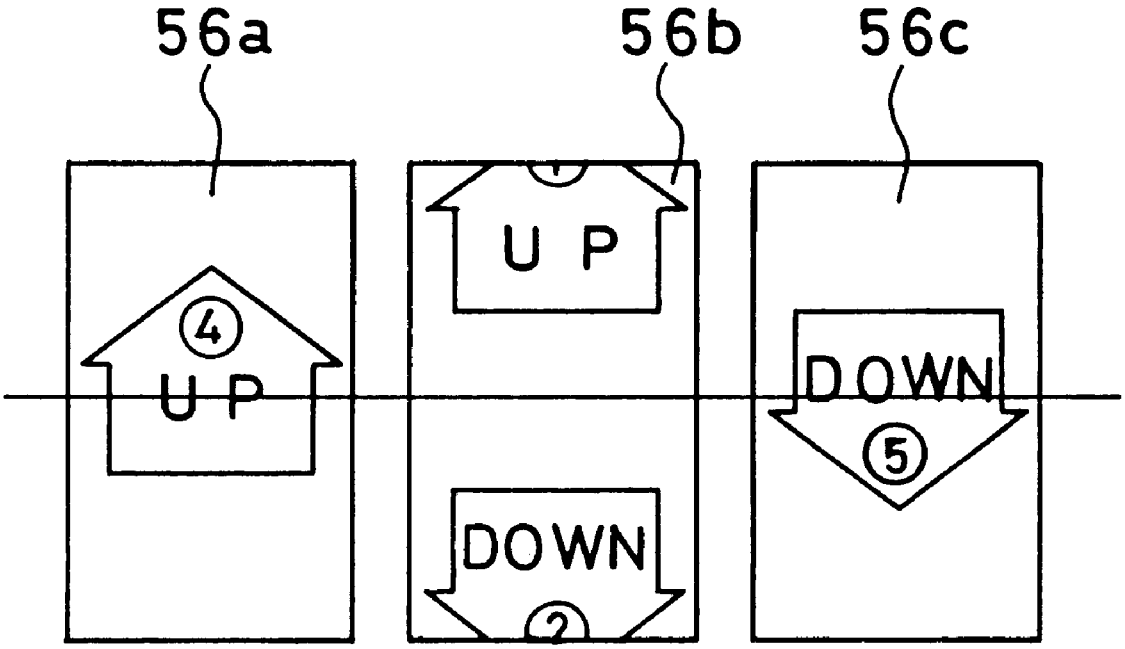
FIG. 7 is a plan view showing another embodiment of symbols of a second reel group.

FIG. 7 shows another embodiment of the present invention. In this embodiment, a numeral representing a rotational amount is added to the re-rotation symbol arranged on the reels 56*a*, 56*b* and 56*c* of the second reel group. At this time, the re-rotation symbol represents not only the rotational direction but also the rotational amount with regard to the re-rotation of the corresponding reel of the first reel group. The numeral added to the re-rotation symbol represents the number of rotated symbols on re-rotating the reel of the first reel group. Upon using such re-rotation symbol, various changes may be given according to the kind of the re-rotation symbol when the reel of the first reel group is re-rotated. In this case, even if the symbol "7" does not stop at the position shifted by one symbol and is not displayed in the symbol displaying window 2, there is a possibility that the symbol combination of "7-7-7" is displayed at the winning line. Accordingly, the other interest is given to the slot machine.

When the present invention is embodied, the number of the reels constituting the first reel group and the second reel group may be suitably determined. It is preferable that the reels of the first reel group and the reels of the second reel group are disposed in the vertical direction or in the horizontal direction as described in the above embodiments. However, the position of the reels of the second reel group is not exclusive to these embodiments.

It is possible to constitute the second reel group with only one auxiliary reel, although the first reel group is constituted of a plurality of reels. In this case, a reel selection mark for selecting the reel of the first reel group is added to the re-rotation symbol provided on the auxiliary reel of the second reel group. By reading out the reel selection mark on the basis of the stop position of the auxiliary reel, selected reel of the first reel group is re-rotated in accordance with the re-rotation symbol of the auxiliary reel. Alternatively, it is possible to adopt that all the reels of the first reel group displaying the blank symbol is re-rotated when the auxiliary reel stops the re-rotation symbol at the judging line.

As to the symbol arrangement of the first reel group, the specific symbol of the blank symbol and so forth may not be necessarily provided on alternate valid symbols. It is possible to adopt that the specific symbol is provided sporadically or by only one per reel. Moreover, the re-rotational amount of the reel of the first reel group may be suitably set. When the specific symbol is displayed again after the re-rotation, whether the game is over or continued to re-rotate the reel successively is suitably decided.

The present invention is available to the slot machine in which the specific symbol for re-rotation, for example the blank symbol, is not provided on the reel of the first reel group. In this case, after each reel of the first reel group has stopped, re-rotation process may be carried out only when the winning is not obtained at all the valid winning lines and the reel of the second reel group displays the re-rotation symbol. Moreover, it is possible to adopt a game mode in which the reel of the first reel group is re-rotated in accordance with an operation of a corresponding re-rotation button. This re-rotation button is selectively operated by the player when the re-rotation is permitted due to the reel of the second reel group, even if the winning is obtained at any of the winning lines when the reels of the first reel group have stopped once.

As to the slot machine in which the bonus game is performed when the specific symbol combination is obtained by the reels of the first reel group, it is possible to use the reel of the second reel group as the reel for the bonus game. By the way, the present invention is available to a video-type slot machine as well. In the video-type slot machine, a reel rotation is simulated in a CRT on the basis of graphic data stored in ROM. Besides that, it is possible to employ the present invention as a symbol changing device of another game machine, for example, a pinball game machine, a bingo game machine and a pusher game machine.

As described above, in the slot machine according to the present invention, the auxiliary reel is provided besides the first reel group. When the prescribed symbol of the auxiliary reel stops at the predetermined position, at least one of the reels of the first reel group is re-rotated after all the reels of the first reel group have stopped. Thus, the symbol combination displayed by the first reel group and stopping at the winning line is changed. Accordingly, other chance of the winning is obtained in comparison with the conventional slot machine so that the new interest is given to the slot machine.

Moreover, when the auxiliary reel is provided so as to correspond to each reel of the first reel group and each reel of the first reel group is re-rotated in accordance with the stop position of the corresponding auxiliary reel, much greater interest may be obtained. In another embodiment of the present invention, the first reel group is provided with a plurality of reel rows constituted of plural reels and the winning is judged in accordance with the symbol combination of each reel row. The auxiliary reels are respectively provided for each reel row so as to correspond one by one. After the reels of the reel row have stopped, the reel is re-rotated in accordance with the stop position of the corresponding auxiliary reel. Accordingly, greater interest is further obtained.

It is possible to change the game mode variously by providing the specific symbol on each reel of the first reel group. As described above, when the specific symbol stops at the winning line and the prescribed symbol provided on the auxiliary reel stops at the predetermined position, the reel of the first reel group is re-rotated.

When the prescribed symbol of the auxiliary reel represents the rotational direction in which the reel of the first reel group is re-rotated, the re-rotational direction of the reel is clearly recognized. Accordingly, an expectation feeling for the winning increases. Further, when the prescribed symbol of the auxiliary reel represents the rotational amount by which the reel of the first reel group is re-rotated, it is possible to estimate a moving amount of the reel of the first reel group. Accordingly, the expectation feeling is further increased.

In the above-described embodiment, the main reels of the first reel group and the auxiliary reel of the second reel group are rotated together by operating the start lever, and the auxiliary reel is automatically stopped after all of the main reels have stopped. However, the auxiliary reel may be stopped before all of the main reels stop.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A slot machine having N main reels, wherein N is an integer, on a peripheral surface of which various symbols are arranged, in said slot machine, a winning is determined in accordance with a combination of said symbols stopping at a winning line when said main reels have stopped, said slot machine comprising:

at least one auxiliary reel having a prescribed symbol arranged on a peripheral surface thereof; and main reel re-rotation control means for re-rotating and stopping at least one of said main reels when said prescribed symbol of said auxiliary reel stops at a predetermined position, said main reel being re-rotated in order to change a symbol combination displayed by said main reels and stopping at said winning line.

2. A slot machine according to claim 1, wherein a number of said auxiliary reels is N, and said N auxiliary reels are respectively provided so as to correspond to each of said main reels in order to re-rotate said main reel in accordance with said corresponding auxiliary reel.

3. A slot machine according to claim 2, wherein said auxiliary reel is disposed just above said corresponding main reel.

4. A slot machine according to claim 1, wherein said N main reels are disposed in matrix and a number of said auxiliary reels is N1, said N1 auxiliary reels being respectively provided for each reel row of said main reels so as to re-rotate each reel of said reel row in accordance with said corresponding auxiliary reel.

5. A slot machine according to claim 4, wherein said auxiliary reel is disposed at an above side of said reel row.

6. A slot machine according to claim 4, wherein said N main reels are disposed in matrix and a number of said auxiliary reels is N2, said N2 auxiliary reels being respectively provided for each reel row of said main reels so as to re-rotate each reel of said reel row in accordance with said corresponding auxiliary reel.

7. A slot machine according to claim 6, wherein said auxiliary reel is disposed at a lateral side of said reel row.

8. A slot machine according to claim 2, wherein said main reel and said auxiliary reel are rotated together by operating a start operating member, and said auxiliary reel is automatically stopped after all of said main reels have stopped.

9. A slot machine according to claim 2, wherein said main reel and said auxiliary reel are rotated together by operating a start operating member, and said auxiliary reel is automatically stopped before all of said main reels stop.

10. A slot machine according to claim 2, wherein said auxiliary reel has a smaller diameter in comparison with said main reel.

11. A slot machine according to claim 1, wherein a specific symbol is arranged on said main reel, and said main reel is re-rotated and stopped when said specific symbol stops at said winning line and said prescribed symbol of said auxiliary reel stops at said predetermined position.

12. A slot machine according to claim 11, wherein said specific symbol is a blank symbol.

13. A slot machine according to claim 1, wherein said prescribed symbol of said auxiliary reel represents a rotational direction on which a re-rotational direction of said main reel is determined.

14. A slot machine according to claim 13, wherein said rotational direction is shown by an arrow.

15. A slot machine according to claim 13, wherein said rotational direction is shown by a character of "UP" or "DOWN".

16. A slot machine according to claim 1, wherein said prescribed symbol of said auxiliary reel represents a rotational amount on which a re-rotational amount of said main reel is determined.

17. A slot machine according to claim 16, wherein said rotational amount is shown by a number of rotated symbols.

* * * * *